US009630184B2

(12) United States Patent
Stone

(10) Patent No.: US 9,630,184 B2
(45) Date of Patent: Apr. 25, 2017

(54) OSCILLATION MONITOR FOR PULVERIZER JOURNAL ASSEMBLY

(71) Applicant: General Electric Technology GMBH, Baden (CH)

(72) Inventor: Richard Brian Stone, Teaneck, NJ (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 0 days.

(21) Appl. No.: 15/285,640

(22) Filed: Oct. 5, 2016

(65) Prior Publication Data

US 2017/0021362 A1 Jan. 26, 2017

Related U.S. Application Data

(62) Division of application No. 14/068,136, filed on Oct. 31, 2013, now Pat. No. 9,486,810, and a division of application No. 12/951,172, filed on Nov. 22, 2010, now Pat. No. 8,602,338.

(51) Int. Cl.

| | |
|---|---|
| ***B02C 25/00*** | (2006.01) |
| ***B02C 15/04*** | (2006.01) |
| ***G08B 21/18*** | (2006.01) |

(52) U.S. Cl.

CPC ..... *B02C 25/00* (2013.01); *B02C 15/04* (2013.01); *G08B 21/187* (2013.01)

(58) Field of Classification Search

CPC ..... B02C 25/00; B02C 15/04; G08B 21/187

See application file for complete search history.

(56) References Cited

U.S. PATENT DOCUMENTS

| | | | | |
|---|---|---|---|---|
| 4,372,496 | A * | 2/1983 | Maliszewski | B02C 25/00 241/109 |
| 2004/0088129 | A1* | 5/2004 | Satola | B02C 21/02 702/113 |
| 2005/0263630 | A1* | 12/2005 | Zhang | B02C 15/00 241/100 |
| 2009/0308961 | A1* | 12/2009 | Nelson | B02C 15/04 241/121 |
| 2010/0288862 | A1* | 11/2010 | Wark | B02C 15/007 241/37 |

* cited by examiner

*Primary Examiner* — Mark Rosenbaum

(74) *Attorney, Agent, or Firm* — GE Global Patent Operation; Stephen G. Midgley

(57) ABSTRACT

A pulverizer 10 includes a journal assembly 19 with a grinding roller 18 that grinds solids in a grinding table 14. The oscillations of the journal assembly 19 are monitored by an angular displacement transducer (ADT) 32 that creates a composite signal. A controller 83 receives the composite signal from the ADT and compares it with known information of the pulverizer 10. It then identifies abnormal situations such as damage to a grinding roll 14, the grinding table 14, the spring assembly 20 and other parts of the pulverizer 10 before they cause major damage.

4 Claims, 5 Drawing Sheets

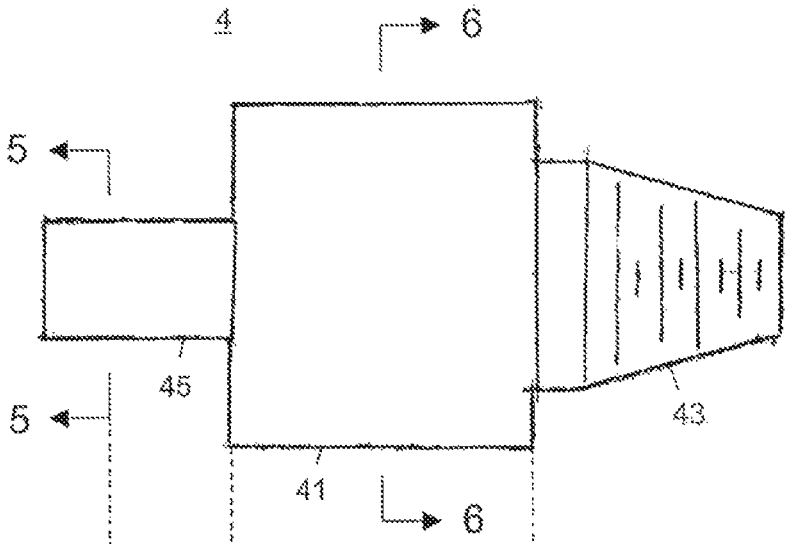
Figure 4
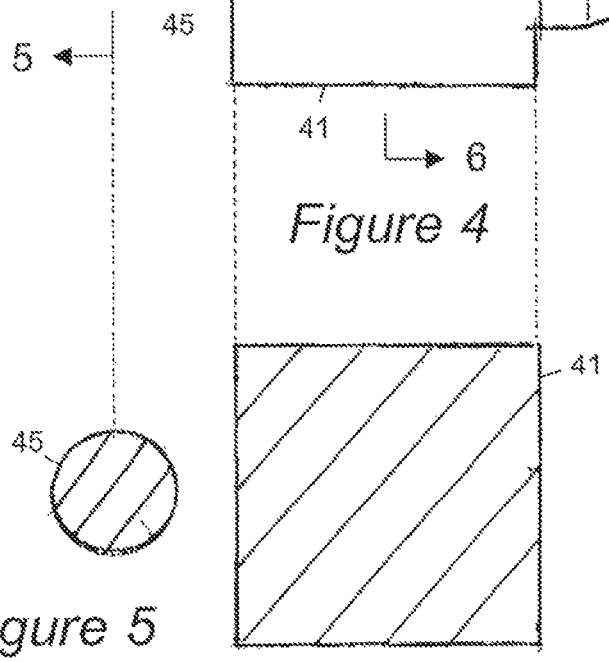
Figure 5
Figure 6

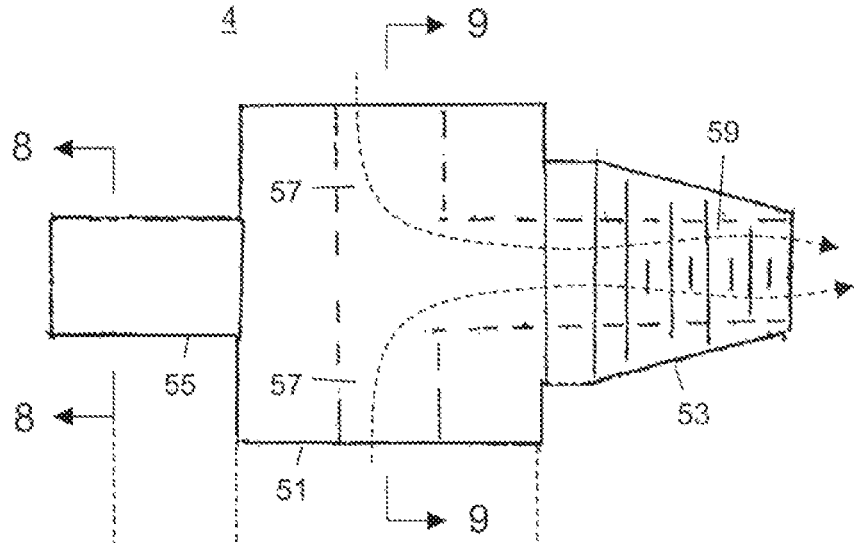
Figure 7
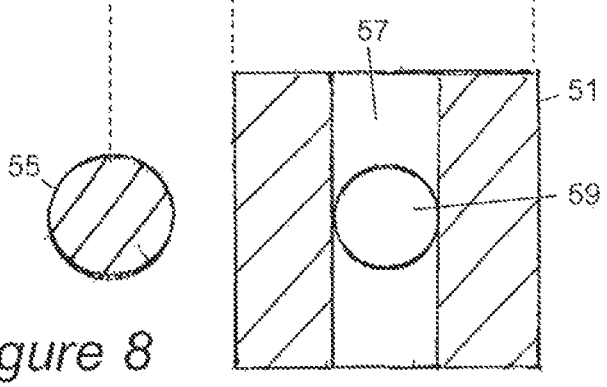
Figure 8
Figure 9

OSCILLATION MONITOR FOR PULVERIZER JOURNAL ASSEMBLY

CROSS-REFERENCE TO RELATED APPLICATIONS

This application is a divisional of U.S. patent application Ser. No. 14/068,136, having a filing date of Oct. 31, 2013, which is a divisional of U.S. patent application Ser. No. 12/951,172, having a filing date of Nov. 22, 2010, issued on Dec. 10, 2013 as U.S. Pat. No. 8,602,338, which are incorporated by reference herein in their entireties.

FIELD OF THE INVENTION

The present invention generally relates to solid fuel pulverizers and is more particularly directed to the measurement of angular displacement of journal assemblies and their attached grinding rolls within solid fuel pulverizers.

BACKGROUND

Solid fossil fuels such as coal often are ground in order to render the solid fossil fuel suitable for certain applications. Grinding the solid fossil fuel can be accomplished using a device referred to by those skilled in the art as a pulverizer. One type of pulverizer suited for grinding is referred to as a "bowl mill pulverizer" 10 as shown in FIG. 1. This type of pulverizer obtains its name by virtue of the fact that the pulverization that takes place on a grinding table 14 that resemblance to a bowl.

The bowl mill pulverizer 10 includes a substantially closed separator body 12. A grinding table 14 is mounted on a shaft 16. A motor and gearbox drive mechanism (not shown) rotate the grinding table 14. These components arranged within the separator body 12.

A plurality of journal assemblies 19 and grinding rolls 18, preferably three, are supported within the separator body 12 so as to be equidistantly spaced one from another around the circumference of the separator body 12. Only one journal assembly 19 and grinding roll 18 of three is shown in FIG. 1. Each of the grinding rolls 18 is supported and rotates on a suitable shaft (not shown) of a journal assembly 19. The journal assemblies 19 and grinding rolls 18 are allowed to pivot away from the grinding table 14 by the trunnion shaft 36.

Each of the grinding rolls 18 has a spring assembly 20 acting on the journal head 70 of the journal assembly 19. Each of the spring assemblies 20 applies a spring load on the corresponding grinding roll 18 causing them to pivot on trunnion shaft 36 and to exert the requisite degree of force on the solid fuel on the grinding table 14 pulverizing the solid fuel into powder.

The solid fuel is provided through fuel inlet tube 22 and falls through to grinding table 14 to be pulverized.

After being pulverized, the particles of the solid fuel are thrown outwardly by centrifugal force, whereby the particles are fed into a stream of warm air and blown into a classifier 30 for separation by particle size. The particles of the proper size are passed out of outlets 34.

The larger particles fall downward through outlet 28 for more grinding. The greater the force, the finer the particle size of the fossil fuels being ground.

There are devices which provide feedback regarding the amount of force being applied to each grinding roll 18 as described in U.S. patent application Ser. No. 12/490,668 filed Jun. 24, 2010 "Force Monitor For Pulverizer Integral Spring Assembly". This does not however, indicate angular displacement of the trunnion shafts 36 and journal assemblies 19.

The forces acting on the journal assembly 19 are the spring force, which forces the journal assembly downward, and the reaction force of the grinding roll upon the solid fuel bed contained on the grinding table 14, which forces the journal assembly upward and downward, creating the oscillations. There are normal oscillations that occur within an acceptable range, however, there are also abnormal oscillations indicating a problem with the pulverizer.

The force measured by load cells do not directly relate to the displacement of the journal assemblies 19. This is because the forces provided by the springs typically do not have a linear relationship with displacement.

The linear change in the spring is related to many thousands of pounds of force. Therefore, it is not very accurate in measuring small forces that have small angular displacements.

Also, the force v. displacement curve exhibited by a spring changes over time as the spring ages.

Due to the non-linear relationship between displacement and force and the fact that springs change their displacement vs. force curve for several reasons, monitoring linear spring displacement relating to oscillations can be inaccurate.

The information that is currently available on conventional pulverizers is the initial spring force (initial spring compression) which is set on each journal spring assembly prior to the pulverizer being placed into service and the initial clearance set between the grinding roll 18 and grinding table 14 (the "roll-ring clearance").

For journal assemblies 19 of shallow bowl type pulverizers, an additional piece of known information is the clearance between a journal head 70 and the seat of the spring assembly 20. However, the accuracy by which each of these items is set is dependent on the skill of the workers, the accuracy of the equipment and gages used by the workers, and the method the worker use to perform the work.

Presently, there is little or no instrumentation present to measure these oscillations. The journal assemblies 19 are currently evaluated visually by watching the end face of the trunnion shaft 36 and comparing its movement to the vibration of the bowl mill pulverizer 10.

This is a crude method and the ability to obtain useful results from it is highly dependent on the experience of the personnel who perform it.

The result is that operation problems or failure of the pulverizer, its grinding components, or its gearbox components can occur before the conditions responsible for creating the problems are noticed and corrected.

Currently, there is a need for feedback to more accurately monitor various abnormalities of a pulverizer.

SUMMARY

According to aspects disclosed herein, the invention may bee embodied as a pulverizer 10 for pulverizing a solid fuel, the pulverizer 10 having a pulverizer housing having a shaft coupled for rotation therein, a grinding table 14 rotatably mounted on the shaft, at least one journal assembly 19 pivotally mounted on the pulverizer housing, a grinding roll 18 coupled to the at least one journal assembly 19, a spring assembly 20 is mounted on the pulverizer housing, wherein the spring assembly 20 urging the grinding roll 18 toward the grinding table 14; and an angular displacement transducer (ADT) 32 coupled to the journal assembly 19 adapted to measure angular displacement of at least one journal assembly 19 and create an electronic signal corresponding to the measured angular displacement.

The invention may also be embodied as a method of identifying potential problems of a pulverizer 10. The method includes the steps of acquiring angular displacement signal of at least one journal assembly 19 over time, and indicating that there is a potential problem with the pulverizer 10 when the angular displacement signal is an abnormal signal.

The abnormal signal may be a signal that exceeds a maximum or minimum angular displacement, or has an average angular displacement greater than a predetermined threshold The invention may also be embodied as a device for measuring the operation of at least one journal assembly 19 pivoting on a trunnion shaft 36 of a pulverizer 10 having an angular displacement transducer (ADT) adapted to measure the degree of rotation of a shaft, a coupling 3 attached between the trunnion shaft and having a shaft connected to the ADT for transmitting rotation of the trunnion shaft to the ADT thereby causing the ADT to constantly measure the trunnion shaft 36 rotation, a controller 83 coupled to the ADT for reading the measured rotation and for identifying abnormal operation conditions.

BRIEF DESCRIPTION OF THE DRAWINGS

Referring now to the figures, which are exemplary embodiments, and wherein like elements are numbered alike:

FIG. 4 is a side elevational view of a pressure retaining-type coupling adapter 4 according to one embodiment of the present invention.

FIG. 5 is a cross section of FIG. 4 as view from the lines marked "5-5".

FIG. 6 is a cross section of FIG. 4 as view from the lines marked "6-6".

FIG. 7 is a side elevational view of a suction-type coupling adapter 4 according to one embodiment of the present invention.

FIG. 8 is a cross section of FIG. 7 as view from the lines marked "8-8".

FIG. 9 is a cross section of FIG. 4 as view from the lines marked "9-9".

DETAILED DESCRIPTION

Magnitude

Figure 1:
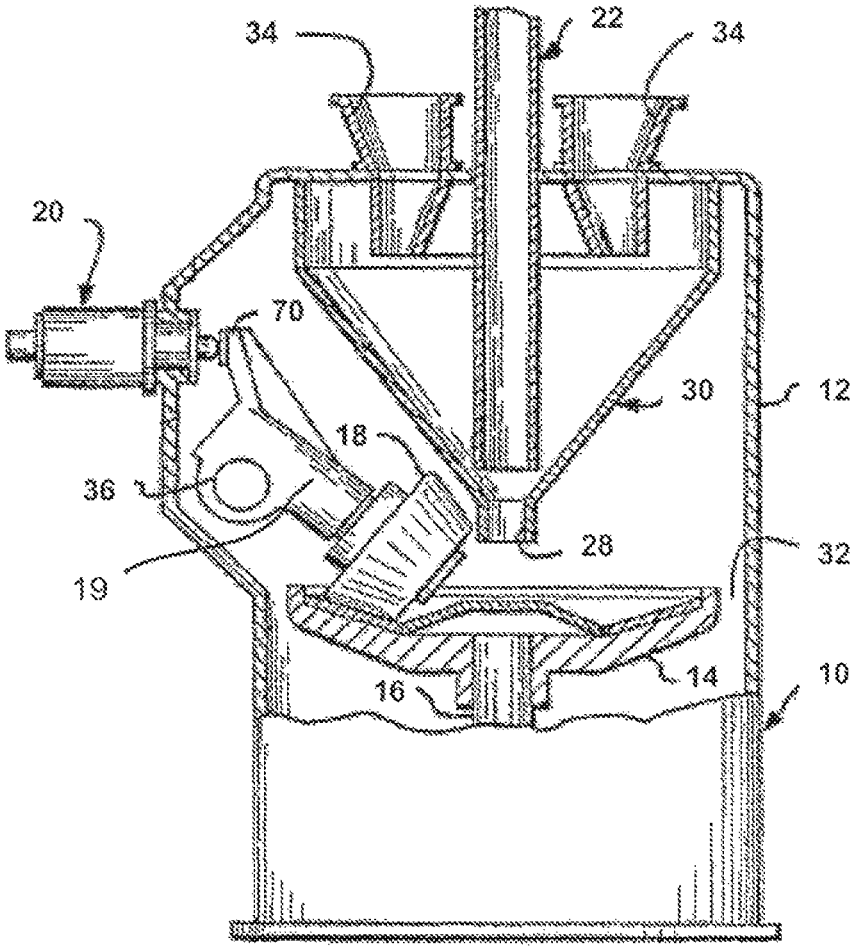
FIG. 1 is a perspective view of a bowl mill pulverizer showing the journal assembly, grinding roll, spring assembly and rotating grinding table.

Referring again to FIG. 1, during operation of a bowl mill pulverizer 10, the forces that act on each journal assembly 19 cause it to oscillate continuously in the upward and downward direction, rotating around a trunnion shaft 36. Oscillations having a magnitude within a normal range are acceptable. Oscillations having a magnitude outside of a normal range can indicate problems with the bowl mill pulverizer 10.

Frequency

Measuring the oscillation of a journal assembly 19 over time will result in a complex oscillation signal comprised of multiple overlaid frequencies. There are also several (usually three) journal assemblies 19 that are monitored, providing these signals. Proper analysis of these signals alone, or in combination will provide indications of problems occurring in the bowl mill pulverizer 10.

Phase

Even if two identical journal assemblies 19 were to react exactly the same and produce the same signal under the same conditions, the signals of each would be 120 degrees our of phase (in an equally spaced three-journal bowl mill pulverizer 10).

If the oscillation signals from the journal assemblies 19 were properly acquired, they could be correlated with known information regarding the geometry and functioning to identify problems that exist with pulverizer 10. Therefore, signals may be identified that indicate one or more potential problems occurring within the pulverizer 10, before major damage occurs.

A prior art load cell of a conventional pulverizer only measures positive, or pushing forces of the spring assembly as described in U.S. patent application Ser. No. 12/490,668 above. There are no measurements of the actual journal assembly movement (oscillation) as the forces of the spring assembly and coal bed are applied to it.

Equal Oscillation

Unequal oscillation among the journal assemblies 19 creates a variable loading of the grinding and gearbox components of the pulverizer 10. It also creates reaction forces transmitted back to the journal assemblies 10.

It is important that all journal assemblies oscillate equally in order to:

a. prevent bending and failure of the pulverizer gearbox components, b. provide the necessary coal fineness for efficient boiler operation, boiler combustion and emissions control.

The present invention monitors angular displacement (oscillation angle) over time for each journal assembly 19. These signals are processed to determine an overall running maximum/minimum amplitude (oscillation range), maximum amplitude for a defined period of time and repeated patterns (oscillation rate). These are correlated with the frequency of grinding table 14 rotation, and grinding roll 18 rotation. These are then used to identify problems within the pulverizer.

Figure 2:
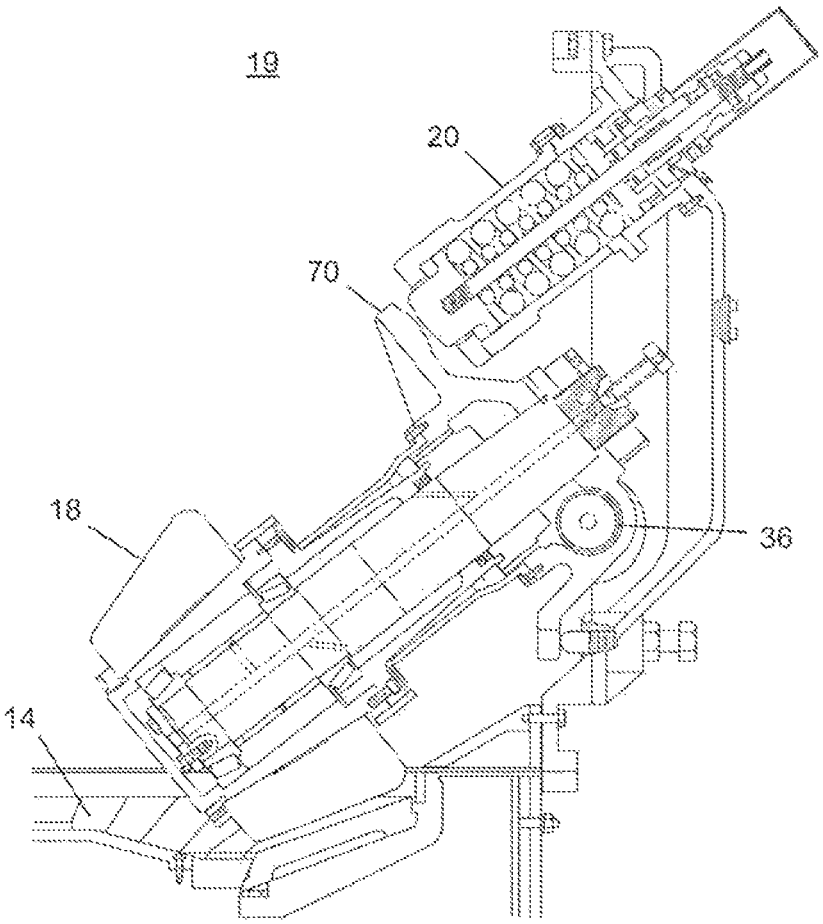
FIG. 2 is an enlarged, cross-sectional view of the bowl mill pulverizer of FIG. 1 including the having an angular transducer according to the present invention.

FIG. 2 shows an embodiment of a journal assembly compatible with the present invention. For ease of illustration, only one journal assembly 19 and associated spring assembly 20 are shown and described, but the invention is not limited in this regard, and in other embodiments the pulverizer 10 may comprise two, three, or more journal assemblies and associated spring assemblies, which may be evenly distributed about the grinding table 14.

The journal assembly 19 carries grinding roll 18 rotatably mounted thereon and positions the grinding roll to define a gap $G_1$ between the grinding roll and the grinding table 14. The gap $G_1$ varies when the journal assembly 19 pivots on the trunnion shaft 36. Optionally, the journal assembly 19 may be configured so that there is a gap $G_2$ between the journal head 78 and the spring assembly 20. The gap $G_2$ is at a maximum when the journal assembly pivots fully forward, i.e., when the gap $G_1$ is at a minimum.

An angular transducer 32 is attached to the journal assembly, near the trunnion shaft 36. It monitors the angular (rotation) about the trunnion shaft 36. This effectively measures the oscillations of journal assembly 19 over time.

The signals from the angular transducer 32 are conveyed via the output lead 2 to a controller 83 (e.g., suitable data monitor and recording equipment, a programmable logic controller and/or a suitably programmed general purpose computer) that may optionally be positioned in a control room for observation and analysis by a user. In addition, the signal from the output lead 36 enables the user to measure, record and display the angular movement (oscillation) of journal assembly 68 over time during operation of the pulverizer 10.

In conventional pulverizers, the result is that operational problems or failure of the pulverizer, its grinding components, or its gearbox components can occur before the condition responsible for creating the problem is noticed and repaired or corrected. In the present invention, the signal from the angular transducer 32 is monitored to provide early detection of abnormalities. This data will permit the real time detection, analysis and correction of problems with the pulverizer 60 mechanical components and performance during operation.

The installation of an oscillation monitor 32 onto each journal assembly 19 of the pulverizer 10 will enable the oscillation rate, oscillation range, oscillation angle, and rate of change of the angular displacement of each journal assembly during operation to be displayed, monitored and recorded at the pulverizer and in the control room of a power plant.

The process signal may be used to detect several different abnormal conditions, as described below.

1. Improper Initial Clearance Set Between the Grinding Roll 18 and Grinding Table 14 (the Roll/Ring Setting Procedure)

The oscillation signal from one journal assembly 19 is consistently higher, on the average, than the others.

2. Improper Depth of the Coal Bed on the Bowl

More than one journal assembly 19 indicates continuous average angular deflections that are above (or below) a predetermined threshold.

3. Weakening, Damage or Fatigue of the Journal Spring Assembly 20

This will be indicated by greater maximum and minimum oscillations as compare with the other journal assemblies 19.

4. Increased Wear and Location of Wear on the Grinding Roll

Small continuous oscillations from a single journal assembly 19 indicating a rough grinding roll surface such as caused by its surface being broken apart.

A periodic local minimum oscillation with a period equal to the circumference of a grinding roll is sensed, indicating a flat side to the grinding roll.

The phase of the signal will indicate where the flat location is on the grinding roll.

5. Decreased Roundness (Circularity) of the Grinding Roll

A repeated periodic signal with a period of the grinding roll circumference will be sensed.

6. Increased Wear and Location of Wear on the Bowl Grinding Table

Small continuous oscillations from a single journal assembly 19 indicating a rough grinding table 14 surface.

7. A Cracked or Warped Grinding Table 14

A quick angular rate of change at a one or more points in the signal with a pattern that repeats with a period equal to the grinding table 14 rotation indicated a cracked grinding table 14. A warped grinding table will have a smooth characteristic periodic wave with a period equal to that of the rotating grinding table 14.

8. Debris/Rocks on the Grinding Table 14

A signal similar to a cracked grinding table 14 is indicated, if the debris is attached to the grinding table 14.

A quick rate of angular change at random points in the signal with no periodic pattern will be sensed if the rocks are not attached to the grinding table 14.

Implementation

Figure 3:
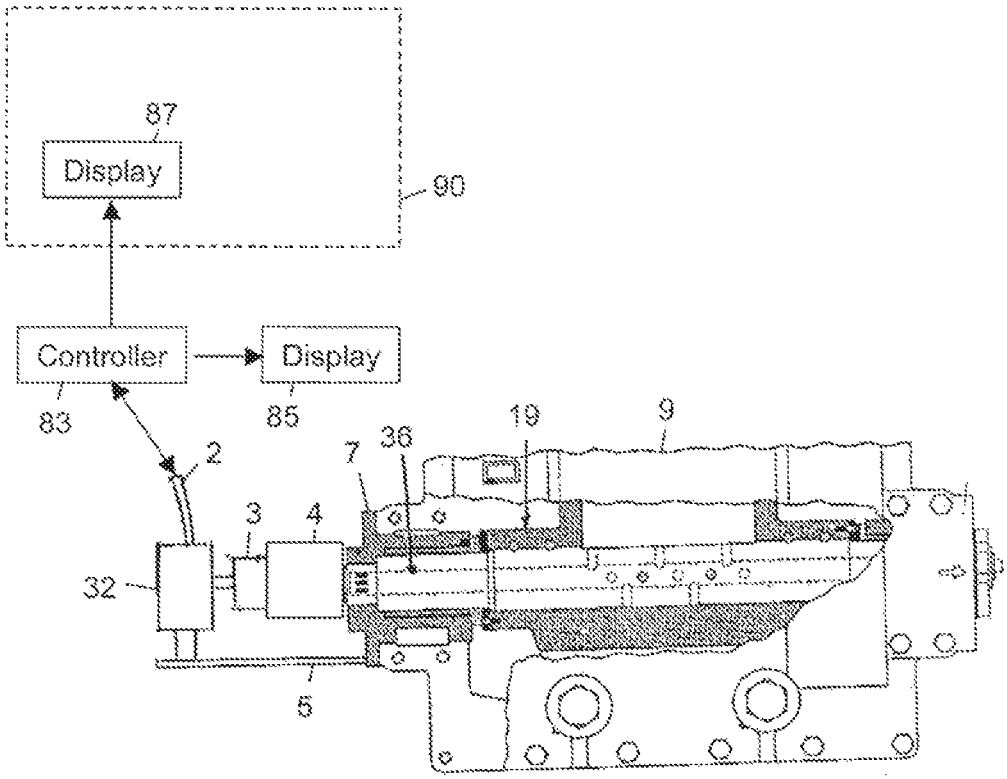
FIG. 3 is an enlarged view of one embodiment of an oscillation monitor according to the present invention.

FIG. 3 shows the present invention as it will be installed on a pulverizer 10. This is a partial cut-away view showing the trunnion shaft 36 extending horizontally. The trunnion shaft 36 extends through the trunnion shaft end cap 7. It is then attached to a coupling adapter 4 that may be a pressure retaining type adaptor or may be a suction type adapter.

A coupling 3 attaches the angular transducer 32 to the coupling adapter 4. A mounting bracket 5 supports the added parts.

The signal from the angular transducer 32 is passed through a signal cable 2 to a controller 83 that drives a local display 85 mounted on, or near the pulverizer (10). The controller will operate at least one remote display 87 located in a control room 90, or other areas of the plant. The controller 83 reads the signal provided to it and provides early warnings on local display 85 and remote display(s) 87 when the monitored signals indicate a malfunction. The controller 83 also provides monitoring information of the normal operation of the pulverizer 10.

1) The following parts are required to retrofit an existing bowl mill pulverizer: an angular displacement transducer 32, a signal cable 2 a coupling 3, a coupling adapter 4 and a mounting bracket 5. The remaining parts are the standard ones of the journal assembly 19.

This arrangement enables all movement of the trunnion shaft 6 to be transmitted directly into the angular displacement transducer 32.

2) The angular displacement transducer 1 is installed onto the journal assembly 8 by locating it on one side of the trunnion shaft 36. The body of the angular displacement transducer 32 is fastened to a mounting bracket 5 that is either fastened to the journal opening cover, the trunnion shaft end cap 7, or another stationary part of the pulverizer, the journal assembly (B), or the work deck. The mounting bracket 5 holds the body of the angular displacement transducer 1 stationary during operation.

When Pulverizer is the pressurized type (RPS, RP & HP) on which a pressurized seal air system is used, the angular displacement transducer 32 is installed on the opposite side of the journal assembly 19 where a seal air hose connects to the trunnion shaft 36.

When Pulverizer is a suction type (RB & RS), the angular displacement transducer (1) can be installed on either side of the journal assembly 8.

3) In FIG. 3, the angular displacement transducer 32 has a rotating input shaft 33 that extends from its body. The rotating input shaft 33 is fastened tight to one end of the coupling 3 by use of a mechanical connection arranged to eliminate all lost motion. The other end of the coupling 3 connects to the coupling adapter 4 and is held tightly to it using a mechanical connection to eliminate all lost motion.

4) The coupling 3 is arranged to transmit all motion that enters into it and to eliminate all lost motion. The coupling 3 can be either a rigid type or the flexible type.

The use of flexible coupling 3 will enable the angular displacement transducer 32 to be mounted off center (not in alignment with the trunnion shaft 36 center line) without loss of rotational motion. This enables the angular displacement transducer 32 to be installed in locations where access space is restricted.

5) The coupling adapter 4 is fastened rigidly to the trunnion shaft 36. It is arranged to transmit all angular motion that it experiences.

The attachment of the coupling adapter 4 to the trunnion shaft 36 can be by the following methods:

a) by threading it into the trunnion shaft bore using the existing NPT pipe thread within the bore, b) by welding it to the trunnion shaft, or c) by bolting it using new holes drilled and tapped into the trunnion shaft.

When Pulverizer is the shallow bowl pressurized type (RPS, RP & HP) the coupling adapter 4 is arranged to prevent the escape of the pressurized seal air from the trunnion shaft 36.

When Pulverizer is the shallow bowl suction type (RS), the coupling adapter 4 is arranged with air passages within it to allow atmospheric air from the work deck to enter into the trunnion shaft 36 as seal air.

When pulverizer is the deep bowl suction type (RB), no provision for seal air is required in the coupling adapter 4.

6) The signal cable 2 is located on the body of the angular displacement transducer 32.

The signal cable 2 supplies the input power to the angular displacement transducer 32 and returns the output signal from it for processing. The signal cable 2 is the flexible, high temperature resistant, shielded type to prevent failure from grease, vibration, and high temperature at the pulverizer and the work deck that surrounds the pulverizer. The signal cable 2 is equipped with quick-disconnect fittings to speed assembly to and removal from the angular displacement transducer 32 and the adjoining system wiring.

7) The output signal from the angular displacement transducer 32 is displayed and recorded in the control room for observation and analysis by use of suitable data monitoring and recording equipment.

The signal is processed to show the oscillation rate, oscillation range, and oscillation angle that occur on each journal assembly 19 of the pulverizer.

The basic unit of the data obtained for the display is "degrees of rotation". This is used because it is applicable to all types and sizes of journal assemblies.

The processed signals will permit the real time detection, analysis and correction of problems with the pulverizer mechanical components and performance during operation.

In addition, the present invention provides the following advantages over conventional systems:

Plant safety can be improved by providing real time detection and analysis of the signal from the angular transducer 32, which can provide early indications of several types of mechanical and operation problems in a pulverizer 10.

It will simplify the work required to equalize the adjustment and setting of each journal assembly 19 and spring assembly 20 in order to reduce the imbalance forces that act on the gearbox components. This, in turn, will extend the service life of the gearbox components.

The design simplifies and improves the accuracy of the adjustment process of the journal assemblies 19, and the spring assemblies 20 and other devices on the pulverizer 10 to maintain the required coal fineness necessary for proper combustion and emissions control.

It can be installed without having to obtain access to or modify any of the spring assembly 20 components.

It is easily removed, and the majority of the components can be replaced during operation without having to remove the pulverizer from service.

The data collected is not affected by the clearance between the journal head 70 and pressure spring seat of the spring assembly 20. In addition, the design will show if the clearances between the journal head 70 and pressure spring seat are not set equally.

The angle in degrees of rotation is measured that makes the system applicable to all types and sizes of journal assemblies 19 because it does not require conversion to account for the different designs of journal assemblies 19.

FIGS. 4, 5 and 6 show a pressure retaining-type embodiment of coupling adapter 4 compatible with the present invention that uses pressurized seal air to stop coal dust from building up journal oil seals and bearings.

FIG. 4 is a side elevational view of the pressure retaining-type coupling adapter 4. The coupling adapter 4 has a threaded shaft 43 extending from a body 41. A pressure-retaining type of adapter stops the pressurized seal air flowing through the center opening in the trunnion shaft (36 of FIGS. 1-3) from leaking out. Therefore, the threaded shaft 43 threads into the trunnion shaft (36 of FIGS. 1-3) in a manner that prevents seal air leakage.

FIG. 5 is a cross section of FIG. 4 as view from the lines marked "5-5". Here a cross section of a solid shaft 45 is shown. This shaft 45 connects to the coupling (3 of FIG. 3) and transmits any rotation of shaft 45 to the coupling.

FIG. 6 is a cross section of FIG. 4 as view from the lines marked "6-6". Here, a solid square cross-section of the body 41 of coupling adapter 4 is shown.

FIGS. 7, 8 and 9 show a suction-type coupling adapter 4 embodiment compatible with the present invention that uses air suction to stop coal dust from building up journal oil seals and bearings.

FIG. 7 is a side elevational view of a suction-type coupling adapter 4 showing a threaded shaft 53 extending from a body 51. A suction-type of adapter 4 allows ambient air to enter and flow through a center opening in the trunnion shaft (36 of FIGS. 1-3). The threaded shaft 43 with a central air duct 59 that threads into the trunnion shaft (36 of FIGS. 1-3).

Body 51 also has side air ducts 57 that are in fluid communication with central air duct 59. Suction from inside of the pulverizer draws ambient air in through the side ducts 57 of body 51, through central duct 57 on through the central opening of trunnion shaft (36 of FIGS. 1-3).

FIG. 8 is a cross section of FIG. 7 as view from the lines marked "8-8". Here a cross section of a solid shaft 55 is shown. This shaft 55 connects to the coupling (3 of FIG. 3) and transmits any rotation of shaft 55 to the coupling.

FIG. 9 is a cross section of FIG. 4 as view from the lines marked "9-9". Here a solid square cross-section of the body 51 of the coupling adapter 4 is shown.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of identifying potential problems of a pulverizer comprising the steps of:

providing a pulverizer housing with a rotatable shaft, a grinding table mounted on the rotatable shaft, at least one journal assembly pivotally mounted on the pulverizer housing, a grinding roll coupled to the at least one journal assembly, a spring assembly mounted on the pulverizer housing;

providing an angular displacement transducer (ADT) coupled to the journal assembly by a coupling and a coupling adapter, with the ADT, coupling and coupling adapter each supported by a mounting bracket for ADT measurement of angular displacement of the journal assembly and electronic signal generation corresponding to the measurement of angular displacement;

acquiring ADT measurement of angular displacement of the journal assembly over time; and generating an electronic signal indicating a potential problem with the pulverizer when the measurement of angular displacement is abnormal.

2. The method of claim 1 wherein the measurement of angular displacement is abnormal when the measurement of angular displacement exceeds a maximum angular displacement.

3. The method of claim 1 wherein the measurement of angular displacement is abnormal when the measurement of angular displacement is below a minimum angular displacement.

4. The method of claim 1 wherein the measurement of angular displacement is abnormal when the measurement of angular displacement is an average angular displacement greater than a predetermined threshold.

* * * * *